US006192529B1

(12) United States Patent
Jones et al.

(10) Patent No.: US 6,192,529 B1
(45) Date of Patent: Feb. 27, 2001

(54) MODULAR SHOWER ARM CONSTRUCTION

(75) Inventors: Timothy P. Jones, North Olmsted; Norman E. Limpert, Brookpark; Gerald M. Mitchell, Brunswick; Martin Zummersch, Westlake, all of OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/506,882

(22) Filed: Feb. 18, 2000

(51) Int. Cl.[7] ..... A47K 3/22

(52) U.S. Cl. ..... 4/615; 4/678; 137/360; 137/359; 239/282

(58) Field of Search ..... 4/615, 678, 675; 137/359, 360, 801; 285/354, 356, 148.19, 148.23, 8, 46, 90, 136.1, 918, 371; 239/282, 283, 273, 525, 280, 600; 277/602, 608, 609, 614, 625

(56) References Cited

U.S. PATENT DOCUMENTS

| | | | | |
|---|---|---|---|---|
| 931,950 | * | 8/1909 | Mueller | 385/347 |
| 999,332 | * | 8/1911 | Mueller | 285/46 |
| 1,502,154 | * | 7/1924 | Mueller et al. | 137/359 |
| 1,548,570 | | 8/1925 | Wuesthoff . | |
| 1,724,161 | | 8/1929 | Wuesthoff . | |
| 3,136,570 | * | 6/1964 | Lee | 285/193 |
| 3,392,746 | | 7/1968 | Young . | |
| 3,640,305 | | 2/1972 | Young . | |
| 4,272,022 | | 6/1981 | Evans . | |
| 5,195,785 | * | 3/1993 | Jellison | 285/80 |
| 5,275,199 | * | 1/1994 | Howell | 137/360 |
| 6,038,715 | * | 3/2000 | Flieger et al. | 4/601 |

* cited by examiner

*Primary Examiner*—Henry J. Recla
*Assistant Examiner*—Huyen Le
(74) *Attorney, Agent, or Firm*—Cook, Alex, McFarron, Manzo, Cummings & Mehler, Ltd.

(57) ABSTRACT

A modular shower arm construction for use in removably attaching a shower fixture to an unthreaded end of a pipe extending outwardly from a shower wall without affecting connection of the pipe to a water supply system behind the shower wall includes a tubular shower arm, an adapter and a coupling nut. The adapter is fixed to the pipe, either by a set screw or through the use of a threaded nipple. The tubular shower arm has an outwardly flared end which extends within the coupling nut and the coupling nut is threaded onto the adapter and holds the tubular shower arm to the assembled components. An escutcheon overlies and covers all of the connecting elements and is removed when the tubular shower arm and adapter are removed from the unthreaded end of the pipe.

4 Claims, 2 Drawing Sheets

MODULAR SHOWER ARM CONSTRUCTION

THE FIELD OF THE INVENTION

The present invention relates to a modular shower arm construction in which the visible, exterior and/or decorative elements of a shower installation may be removed without affecting or disturbing the connection between the pipe which extends through the shower stall wall and the water supply. It is conventional in shower and bath installations for there to be a pipe which connects to the water supply and extends outwardly through the shower stall wall. This pipe is usually threaded and a shower fixture is threaded onto the pipe. Most homeowners are reluctant to remove an existing shower fixture from the wall because of fear that in so doing they would break the connection between the pipe and the interior water supply.

The present invention provides a mounting system for a shower fixture such as a shower head in which the decorative and exposed elements of the shower assembly, specifically the shower head, the shower arm and the escutcheon, may be removed and replaced with elements of a different esthetic appearance without in any way affecting the behind-the-wall connection with the water supply. There is a pipe which extends outwardly through the shower wall from the water supply and this pipe has a smooth unthreaded end. A tubular shower arm, decorative in outer appearance, is mounted to the pipe through the use of an adapter and a coupling nut. The shower fixture is mounted to the exposed end of the tubular shower arm and an escutcheon overlies and masks or covers the connecting elements.

To attach the components to the pipe, an adapter is first placed on the pipe and may be secured thereto either by a set screw or through the use of a threaded nipple which may be soldered onto the end of the pipe. The tubular shower arm has an outwardly flared end which extends inside of an inwardly directed flange on the coupling nut and these assembled elements are slipped onto the pipe and the coupling nut is threaded onto the adapter, thus assembling the components in a fixed position on the pipe. The escutcheon may then be moved over the assembled elements, after which the shower fixture may be attached to the tubular shower arm.

The reverse process is followed to remove these elements. First, the shower fixture is removed, after which the escutcheon is slid off of the adapter and coupling nut. Then the coupling nut is released from the adapter and it and the shower arm may be removed and replaced with similar mechanical elements, but with a different decorative appearance.

SUMMARY OF THE INVENTION

The present invention relates to a modular shower arm construction and more specifically to a construction in which the decorative appearance of the shower fixture may be changed and the elements of the fixture replaced without affecting the connection between the water supply and the pipe which extends outwardly through the shower stall wall.

Another purpose is to provide a reliable, simply constructed shower arm mounting system which provides for removal of the decorative elements associated with a shower fixture without removing or affecting the tubular water conduit that extends outwardly from the shower stall wall.

Another purpose is a shower connection as described in which all decorative elements may be replaced from in front of the shower stall wall.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

The present invention relates to a mounting system for shower fixtures, such as shower heads, but it can have application to the mounting of bathtub spouts. More specifically, the invention pertains to a mounting system in which the visible, normally decorative, elements of a shower installation may be removed and replaced in connection with changing the decor of a bathroom or lavatory without affecting the water supply pipe connection which is normally located behind the shower wall.

Most homeowners are reluctant to remove an existing shower fixture, as this usually dictates that the connecting pipe must be unscrewed from a fitting behind the wall. Homeowners usually prefer that this finction be performed by a licensed plumber. The present invention provides a mounting system in which all of the decorative components may be replaced without in any way altering or moving the water supply pipe which protrudes through the shower wall and is connected to the water supply system behind the shower wall. The components of the mounting system are all positioned on the water supply pipe in a manner in which they may be simply and easily removed with normal hand tools. The components slide over the conventional copper tube or "stubout." The distance of the shower fixture to the wall may be varied depending on the preference of the homeowner or installation requirements.

Figure 1:
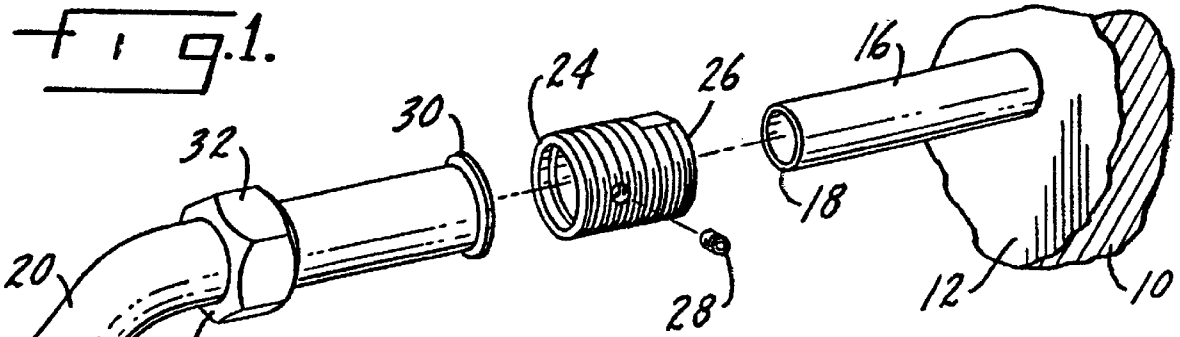
FIG. 1 is an exploded perspective of a first embodiment of the shower arm mounting system of the present invention.
Figure 2:
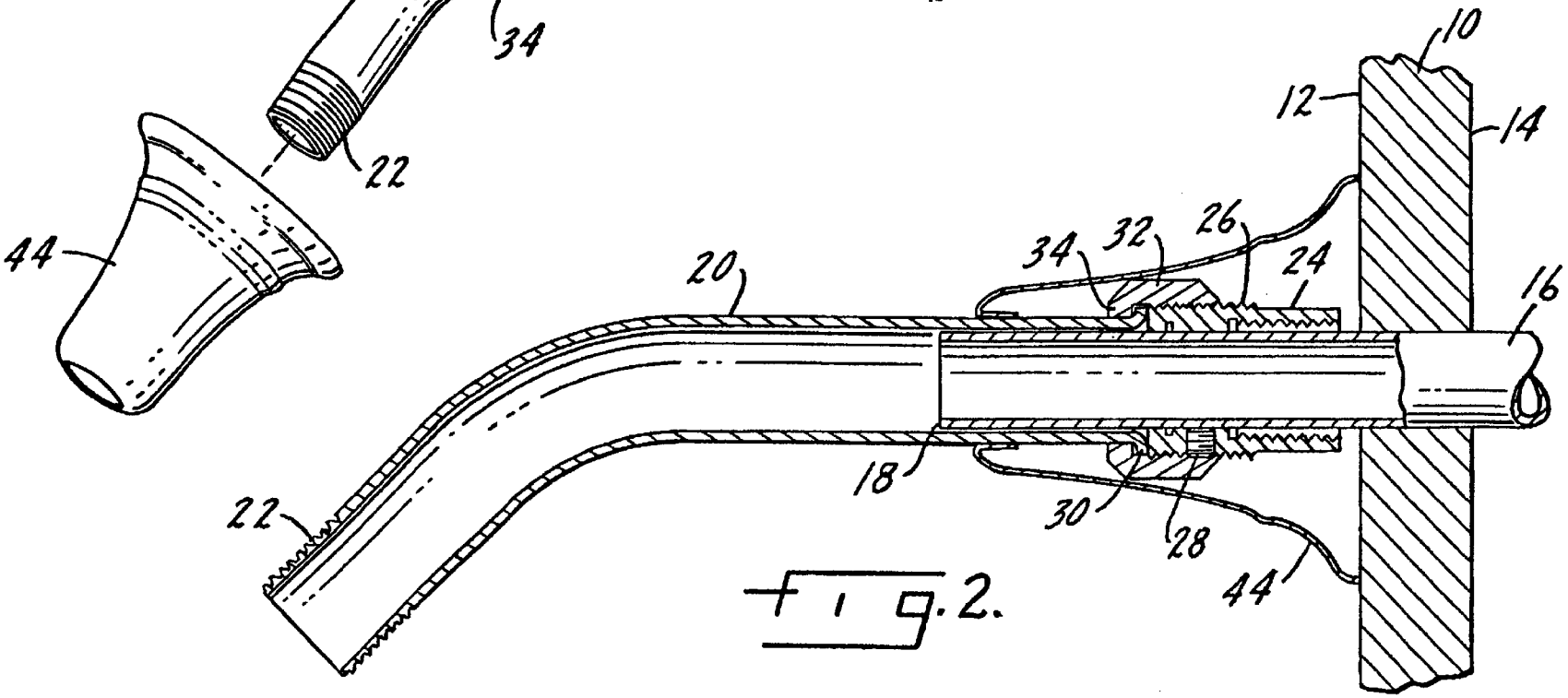
FIG. 2 is an axial section through the embodiment of FIG. 1.

In FIG. 1, the shower wall is shown at 10 and has a front or exposed surface 12 and a rear surface 14, behind which is the conventional water supply conduit. The water supply pipe is indicated at 16 and has an exposed end 18 which is unthreaded, unlike many currently used water supply conduits. A shower arm sleeve or a tubular shower arm is indicated at 20, will have an esthetically pleasing exterior decor, and has a threaded end 22 for the mounting of a fixture such as a shower head. As clearly indicated in FIG. 1, the tubular shower arm 20 will extend over and be coaxial with the supply pipe 16.

Mounted on the supply pipe 16 is an adapter 24 which has an exterior thread 26 and uses a set screw 28 to fix the position of the adapter on the supply pipe 16. The shower arm 20 has its inward wall facing end formed into an outwardly flared projection 30.

There is a coupling nut 32 which is slidably movable on the exterior of the shower arm 20 and has an inwardly directed projection 34 which will cooperate with the flared projection 30 to interlock the coupling nut and the shower arm together.

In assembly, the adapter 24 is first fixed in position on the pipe 16 through the, set screw 28. The coupling nut is passed over the outward end of the shower arm 20 to the point where the projection. 34 is in contact with the flared end 30 of the shower arm. The coupling nut is then screwed onto the adapter with such connection entailing no movement of the shower arm as the coupling nut is rotatable relative to the shower arm. Thus, the flared end of the shower arm will be snugged up tight against the adapter when the installation of the components is complete. The coupling nut/shower arm interlock permits relative rotation between these elements, but relative axial movement is prevented.

Figures 3, 4:
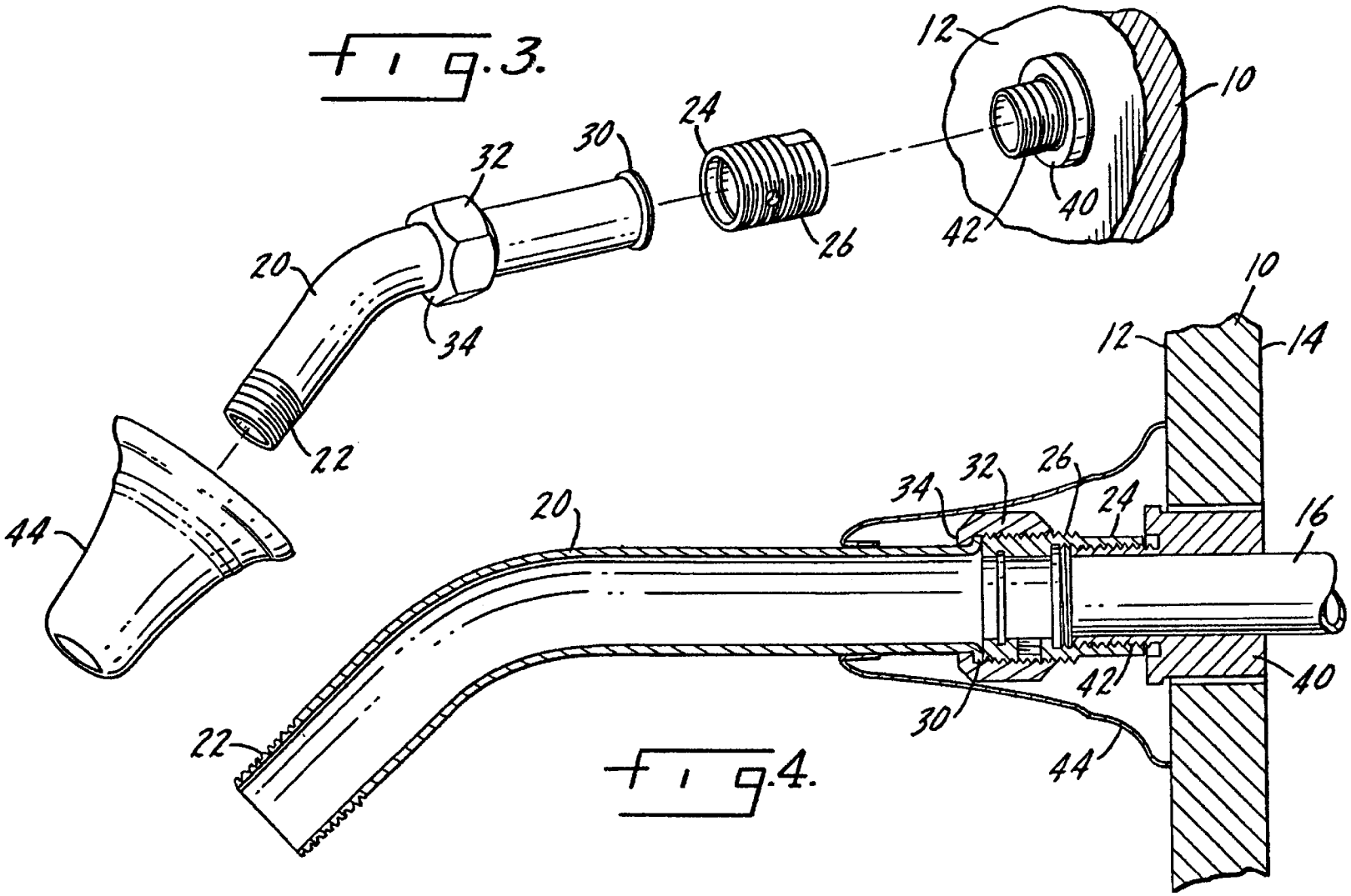
FIG. 3 is an exploded perspective of a second embodiment of the shower arm mounting system of the present invention.
FIG. 4 is an axial section through the embodiment of FIG. 3.

The FIG. 3 embodiment is similar and like parts have been given the same numbers. The principal difference is that in this instance there is a nipple 40 mounted on the exposed end of pipe 16 and the nipple may be fixed in position by soldering or by some other convenient mechanical connection. The nipple has a thread 42 and the adapter 24 will be threaded onto the nipple to mechanically fix the adapter onto the pipe 16. Thus, in effect, the nipple takes the place of the set screw mechanical connection in the FIG. 1 embodiment. All of the remaining elements are similar and the assembly and removal process are the same as in the FIG. 1 embodiment.

Of importance is the fact that the decorative elements of the shower fixture may be removed without affecting the water supply connection. The assembly first entails mounting the adapter on the pipe 16, either through the use of a set screw or the nipple 40. The assembled coupling nut and shower arm are then placed on the pipe and the coupling nut is threaded onto the adapter which connects the shower arm to the pipe 16. The escutcheon 44 is then slid over these assembled elements and masks the connecting components, after which the shower fixture such as a shower head may be attached. The elements are removed by the reverse process. First, the escutcheon is removed, after which the coupling nut 32 is released from the adapter, which allows the shower arm to be removed. The decorative elements may then be replaced with mechanically similar elements, but with a different exterior appearance.

Whereas the preferred form of the invention has been shown and described herein, it should be realized that there may be many modifications, substitutions and alterations thereto.

The embodiments of the invention in which an exclusive property or privilege is claimed are defmed as follows:

1. A modular shower arm construction for use in removably attaching a shower fixture to an unthreaded end of a pipe extending outwardly from a shower wall without affecting connection of the pipe to a water supply system behind the shower wall, said modular shower arm construction including:

a tubular shower arm adapted on one end thereof to mount a shower fixture, an adapter having an exterior thread and being adapted to be mechanically fixed onto said pipe, a coupling nut adapted to be mounted on said pipe, and threadedly connected to said adapter, a mechanical interlock between said coupling nut and another end of said tubular shower arm, said interlock providing for rotary movement between said coupling nut and said tubular shower arm while simultaneously preventing axial movement therebetween, and a decorative escutcheon extending about and covering said adapter, coupling nut and a portion of said tubular shower arm.

2. The modular shower arm construction of claim 1 wherein the interlock between said tubular shower arm and said coupling nut includes an outwardly flared projection on said other end of said tubular shower arm and an inwardly directed projection on said coupling nut, with said flared projection extending inside of said coupling nut.

3. The modular shower arn construction of claim 1 wherein said adapter is fixed on said pipe by a set screw.

4. The modular shower arm construction of claim 1 further including a threaded nipple mounted on said pipe, said adapter being threaded onto said nipple to fix said adapter on said pipe.

* * * * *